US008636174B1

(12) United States Patent
Motkowski et al.

(10) Patent No.: US 8,636,174 B1
(45) Date of Patent: Jan. 28, 2014

(54) ON-DEMAND TEMPERATURE CONTROLLED WATER DISPENSER AND METHOD

(75) Inventors: David G. Motkowski, North Aurora, IL (US); Jonathan D. Shalen, Munster, IN (US); Marek K. Kwiatkowski, Round Lake, IL (US)

(73) Assignee: Food Equipment Technologies Company, Inc., Lake Zurich, IL (US)

( * ) Notice: Subject to any disclaimer, the term of this patent is extended or adjusted under 35 U.S.C. 154(b) by 221 days.

(21) Appl. No.: 12/976,672

(22) Filed: Dec. 22, 2010

(51) Int. Cl.
*B67D 7/80* (2010.01)

(52) U.S. Cl.
USPC ..... 222/1; 222/54; 222/145.5; 222/146.2; 236/12.1

(58) Field of Classification Search
USPC ..... 222/54, 129.4, 145.6, 475.1, 146.1, 1, 222/129.1, 145.5, 146.2, 146.6, 3, 89, 390; 137/9, 334, 607, 625.41; 236/12.11, 236/12.12, 12.15, 12.21, 12.1
See application file for complete search history.

(56) References Cited

U.S. PATENT DOCUMENTS

| | | | | | |
|---|---|---|---|---|---|
| 3,007,609 | A * | 11/1961 | Pascucci | 222/129.2 |
| 3,721,386 | A * | 3/1973 | Brick et al. | 236/12.12 |
| 4,211,342 | A * | 7/1980 | Jamgochian et al. | 222/129.4 |
| 4,420,811 | A * | 12/1983 | Tarnay et al. | 700/285 |
| 4,528,709 | A * | 7/1985 | Getz et al. | 8/158 |
| 4,651,862 | A * | 3/1987 | Greenfield, Jr. | 194/344 |
| 4,774,978 | A * | 10/1988 | Lepine et al. | 137/334 |
| 4,940,164 | A * | 7/1990 | Hancock et al. | 222/66 |
| 5,179,970 | A * | 1/1993 | Jarocki et al. | 137/9 |
| 5,518,031 | A * | 5/1996 | Castel et al. | 137/627.5 |
| 5,819,784 | A * | 10/1998 | Yoon | 137/312 |
| 6,676,024 | B1 * | 1/2004 | McNerney et al. | 236/12.12 |
| 6,915,732 | B2 * | 7/2005 | Jones et al. | 99/275 |
| 7,077,290 | B2 * | 7/2006 | Bethuy et al. | 222/23 |
| 7,156,259 | B2 * | 1/2007 | Bethuy et al. | 222/57 |
| 7,325,747 | B2 * | 2/2008 | Jonte | 236/12.15 |
| 7,411,511 | B2 * | 8/2008 | Kennish et al. | 340/573.1 |
| 7,475,827 | B2 * | 1/2009 | Schmitt | 236/12.11 |
| 7,654,191 | B2 * | 2/2010 | Greenwald et al. | 99/275 |
| 7,757,600 | B2 * | 7/2010 | Jones et al. | 99/275 |
| 7,946,751 | B2 * | 5/2011 | Niermeyer et al. | 366/152.1 |
| 8,225,961 | B2 * | 7/2012 | Anson | 222/54 |
| 2002/0130137 | A1 * | 9/2002 | Greenwald et al. | 222/54 |
| 2007/0267441 | A1 * | 11/2007 | van Opstal et al. | 222/129.4 |
| 2008/0115672 | A1 * | 5/2008 | Jones et al. | 99/275 |
| 2009/0014464 | A1 * | 1/2009 | Adbelmoteleb et al. | 222/1 |
| 2010/0107887 | A1 * | 5/2010 | Bentley et al. | 99/288 |
| 2011/0068118 | A1 * | 3/2011 | Jones et al. | 222/1 |
| 2011/0260872 | A1 * | 10/2011 | Kennish et al. | 340/573.1 |
| 2012/0228328 | A1 * | 9/2012 | Ryan et al. | 222/129.4 |

* cited by examiner

*Primary Examiner* — Kevin P Shaver
*Assistant Examiner* — Daniel R Shearer
(74) *Attorney, Agent, or Firm* — James W. Potthast; Potthast & Associates

(57) ABSTRACT

An on-demand hot water dispenser (10, 90) with a source of hotter water (30) at a preselected relatively elevated temperature (36, 40, 42) and a source of cooler water at a relatively non-elevated temperature compared to the hotter water (17, 52) has an outlet dispense valve (18, 92) connected with both the hotter water source and the cooler water source through a common mixing chamber (74) to selectively vary the temperature of the mixed water being dispensed. The cooler water source (17, 52) is connected to the outlet dispense valve (18, 92) through an electrically controlled proportional valve (72) with a variable flow rate that is controlled during dispensing and mixing in accordance with a comparison between a selected one of a plurality preselected temperatures stored in a controller (34) and a sensed temperature (60, 62) of the mixed water in the mixing chamber (74) to maintain the mixed temperature of the water being dispensed at a preselected temperature on a real-time basis.

10 Claims, 7 Drawing Sheets

ON-DEMAND TEMPERATURE CONTROLLED WATER DISPENSER AND METHOD

BACKGROUND OF THE INVENTION

1. Field of the Invention

This invention generally relates to hot water dispensers and methods of making beverages and other foods that require mixing with hot water at different temperatures and, more particularly, to an electrically powered, automatic hot water dispenser in which the serving temperature of the hot water may be selectively changed on-demand and a method of serving hot water at different temperatures on demand from a single hot water dispenser.

2. Discussion of the Prior Art

Electrical hot water dispensers are well known for use in dispensing hot water at different selected temperatures required for mixing with different food ingredients. For instance, in a tea room, optimum brewing of one type of tea or coffee may require one temperature while a different type of tea may require a lower temperature. Different temperatures may also be needed for preparation of food products, yeast, cocoa, etc.

While known hot water dispensers may be capable of dispensing hot water at different temperatures, a problem with known dispensers is that changing the temperature of the hot water being dispensed from one level to another takes too long accommodate making drinks requiring different optimal water temperatures on demand. Thus, in some dispensers, while the temperature may be changed over several or more minutes, it is not changeable on demand in seconds or fractions of seconds. Consequently, it is known in coffee and tea shops and the like to maintain three or four hot water dispensers with the water in the hot water tanks of each kept at different selected temperatures. Alternatively, some use very high temperature water and manually dilute it by adding cooler water, which creates a hot water handling risk plus adds additional steps to the tea making process. This disadvantageously requires additional counter top space in addition to the multiplication of costs for acquisition, operation and maintenance of a plurality of such dispensers.

In other adjustable hot water dispensers, it is know to mix water from two different sources at different temperatures, such as two separate hot water tanks in the same dispenser, but still such mixing is often still much to slow for rapid dispensing of water at significantly different temperatures and often the mixing rations and temperature are poorly controlled such that the desired dispense temperature is not obtained or not obtained on a reliable basis.

Most water temperature proportioning are mechanical water blenders or use a flow proportioning orifice to mix water at different temperature which results in imprecise temperature control which can result in undesirable results when brewing quality tea or coffee. The methods of mechanical mixing, either thermostatically or electronically, are all subject to an undesirable offset in control caused by an off-differential, or "hysteresis".

SUMMARY OF THE INVENTION

In accordance with the present invention, the disadvantages of known hot water dispensers are overcome by providing a hot water dispenser in which the temperature of the water dispensed may be selectively changed on-demand without delays for changing the temperature required in the known dispensers.

This objective is achieved in part by providing an on-demand hot water dispenser with a source of hotter water at a preselected relatively elevated temperature, a source of cooler water at a relatively non-elevated temperature compared to the hotter water, a outlet dispense valve connected with both the hotter water source and the cooler water source, one of the hotter water source and the cooler water source being connected" to the outlet dispense valve through an electrically controlled proportional valve with a variable flow rate, an electrical temperature sensor for sensing the mixed temperature of water dispensed from the outlet dispense valve after the hotter water and the cooler water is mixed, and means responsive to the electrical temperature sensor during dispensing to control the variable flow rate through the proportional valve to maintain the mixed temperature of the water being dispensed from the outlet dispense valve at a preselected temperature.

In one embodiment, the outlet dispense valve is a manually operated faucet, and in another embodiment outlet dispense valve is a solenoid controlled valve having three inputs respectively connected to the source of hotter water, the source of cooler water and containing the temperature sensor, and an outlet connected to the outlet dispense valve.

Preferably, the hotter water source is a hot water tank, and the cold water source is a connection to a source of pressurized water of a public utility. Means are provided for maintaining the hot water in the hot water tank within a preselected range of temperatures while the source of cooler water is used at whatever temperature it is made available from the public utility.

In both embodiments, the cooler water source is connected to the outlet dispense valve through the proportional valve. The proportional valve is a solenoid controlled valve with a pulse modulated electrical input signal with a duty cycle that determines the flow rate of water through the proportional valve. A controller is connected with the temperature sensor and the proportional valve and has means for storing the preselected temperature. The controller is responsive to the preselected temperature and to the mixed temperature detected by the temperature sensor to vary the duty cycle of the pulse modulated electrical input signal, change to the duty cycle causing a corresponding change to the flow rate through the proportional valve as needed to change the mixed temperature to the preselected temperature during mixing and dispensing. Means are provided for manually inputting to the controller for storage a selected one of a plurality of different preselectable temperatures obtainable by the hot water dispenser.

The objective of the invention is also achieved in part by providing an on-demand hot water dispenser, having means for mixing relatively hotter water with relatively cooler water during dispensing to form a mixture, said mixture having a temperature dependent upon the relative temperatures and flow rates of the hotter water and cooler water into the mixture while the mixture is being dispensed, means for sensing the temperature of the mixture during dispensing, means for controlling the relative flow rates of the hotter water and the cooler water into the mixture in accordance with the mixture temperature during dispensing, and means for dispensing the mixture.

Preferably, the temperature of the mixture is sensed before being dispensed and cooled by ambient air. However, the temperature of the mixture is sensed at a location upstream of, but adjacent to, the dispensing means to substantially eliminate any change in temperature of the mixture as the mixture moves between the location and the dispensing means. The temperature sensing means provides an electrical signal representative of the temperature of the mixture to which the relative flow rate controlling means responds immediately. Preferably, the relative flow rate controlling means includes means for maintaining a relatively constant flow rate into the mixture of one of the hotter water and the cooler water, and means for selectively changing the flow rate into the mixture of another one of the hotter water and the cooler water.

In the preferred embodiment, the means for selectively changing the flow rate is an electrical proportional valve with a controllable variable flow rate. The flow rate through the proportional value is controlled by the duty cycle of a pulse width modulated input signal which is changed in response to the mixture temperature to vary the flow rate through the proportional valve.

Further, the objective of the invention is obtained by providing an on-demand hot water dispenser with, a hot water tank with hot water maintained at a preselected temperature, a dispenser valve for dispensing water from the dispenser, an outlet line extending between the hot water tank and the dispenser valve, and means for infusing relatively cooler water into the outlet line at a flow rate needed to lower the temperature of the water flowing out of the outlet dispense valve when the outlet dispense valve is open. Preferably, the on-demand hot water dispenser also includes means for sensing the average temperature of the water in the outlet line after the cold water has been infused into the outlet line, means for making a comparison of the average temperature with a preselected temperature and means for changing the flow rate based on the comparison. The infusing means includes a proportional valve and means for controlling the valve based on the comparison. Preferably, the means for selectively changing the flow rate selectively changes the flow rate of the cooler water.

Additionally, achievement of the objective of the invention is partly obtained by providing a method of dispensing hot water from a dispenser at a preselected temperature on-demand, by performance of the steps of providing a source of hotter water at a preselected relatively elevated temperature, providing a source of cooler water at a relatively non-elevated temperature compared to the hotter water, passing water from one of the hotter water source and the cooler water source to a outlet dispense valve connected with both the hotter water source and the cooler water source through a proportional valve, sensing the mixed temperature of water dispensed from the outlet dispense valve after the hotter water and the cooler water is mixed with a temperature sensor, controlling the proportional valve to maintain the mixed temperature of the water being dispensed from the outlet dispense valve at a preselected temperature means in response to the temperature sensor.

Also, the objective of the invention is obtained partly by providing a method of dispensing hot water from a dispenser at a preselected temperature on-demand, by performance of the steps of mixing relatively hotter water with relatively cooler water during dispensing to form a mixture, said mixture having a temperature dependent upon the relative temperatures and flow rates of the hotter water and cooler water into the mixture while the mixture is being dispensed, sensing the temperature of the mixture during dispensing, controlling the relative flow rates of the hotter water and the cooler water into the mixture in accordance with the mixture temperature during dispensing, and dispensing the mixture.

Achievement of the invention is also partly acquired by providing a method of dispensing hot water from a dispenser at a preselected temperature on-demand, by performing the steps of maintaining hot water in a hot water tank at a preselected temperature, dispensing water from the dispenser with a outlet dispense valve, and infusing relatively cooler water into an outlet line extending between the hot water tank and the dispenser valve to form a mixture with the hotter water at a flow rate needed to lower the temperature of the water flowing out of the outlet dispense valve when the outlet dispense valve is open and the mixture is being dispensed.

Preferably, the method includes the steps of sensing the average temperature of the water in the outlet line after the cold water has been infused into the outlet line, making a comparison of the average temperature with a preselected temperature, and changing the flow rate based on the comparison. The step of infusing, includes the steps of passing the cold water through a proportional valve, and controlling the valve based on the comparison.

Acquisition of the objective of the invention is also partly obtained by providing an on-demand hot water dispensing system, having a source of hotter water and a source of colder water, a manually operated dispense faucet with a pivotally attached actuation handle, said actuation handle being movable between an upright closed position in which the faucet is closed and a downturned position in which the faucet is open, means for detecting when the faucet has been moved to the open position, and means for enabling mixing of the hotter water with the colder water in response to the faucet detecting means detecting the faucet in the open position.

Preferably, the faucet detecting means includes a photosensor for sensing a change in light when the handle is moved to the open position. The enabling means includes a solenoid controlled hotter water dispense valve for passing hotter water to the faucet and a solenoid controlled colder water valve for passing colder water to the faucet. The enabling means also includes an electronic proportional valve with a variable flow rate, and means for controlling the flow rate to selectively change the temperature of the colder water when it is mixing with the hotter water during passing of the hotter water and the colder water to the faucet when the faucet is detected in the open position and is dispensing a mixture of the hotter water and the colder water. The mixed d temperature of the hotter water and the colder water when mixing is sensed during dispensing and means responsive to the mixed temperature sensing means for controlling the electronic proportional valve to maintain the mixed temperature at a preselected temperature.

Obtainment of the objective is also achieved by providing an on-demand hot water dispensing system, with a source of hotter water and a source of colder water, means for preselecting one of a plurality of preselectable temperatures for water to be dispensed, an electronically controlled outlet dispense valve, a manually actuatable dispense switch for actuating the outlet dispense valve to an open position, means for detecting when the outlet dispense valve has been actuated to an open position, and means for enabling mixing of the hotter water with the colder water to form a dispense mixture passed to the outlet dispense valve in response to the detecting means detecting the outlet dispense valve in the open position, said enabling means controlling the relative flow rates of the hotter water and the colder water being passed to the outlet dispense valve to establish and maintain the dispense mixture at the one preselected temperature.

Preferably, also provided are means for sensing the temperature of the dispense mixture and means responsive to the sensed temperature for selectively varying the flow rate of one of the hotter water and the colder water passing to the outlet dispense valve.

BRIEF DESCRIPTION OF THE DRAWINGS

The forgoing advantageous features and advantages of the hot water dispenser of the present invention will be fully described and other advantageous feature will be made apparent from the following detailed description which is given with reference to the several figures of the drawing, in which.

DETAILED DESCRIPTION

Figure 1:
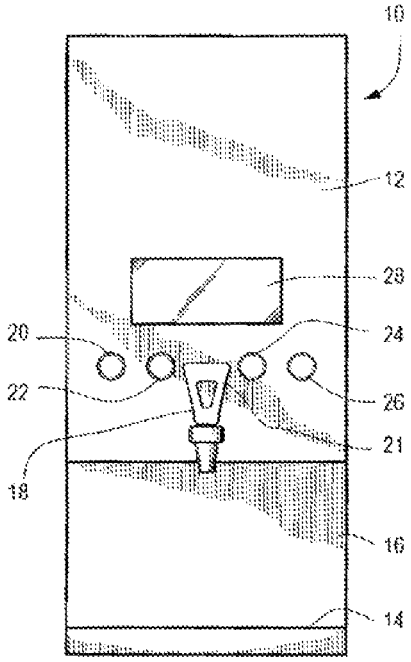
FIG. 1 is a front view of one form of the on-demand temperature controlled water dispenser, or on-demand dispenser of the present invention in which the dispensing of water is controlled by manual operation of a faucet.
Figure 2:
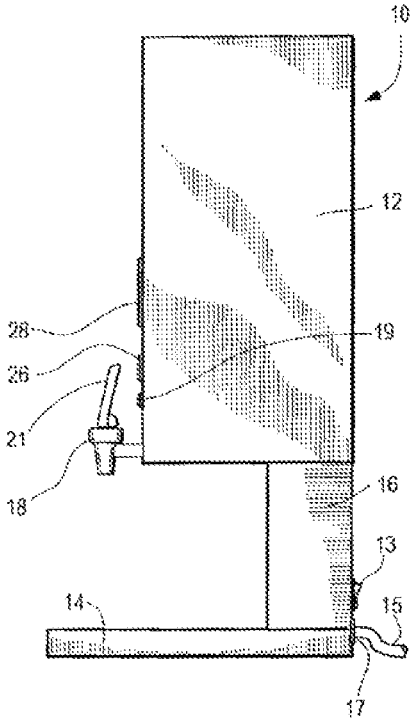
FIG. 2 is a side view of the hot water dispenser of FIG. 1.

Referring to FIGS. 1 and 2, a first embodiment of the hot water dispenser 10 of the present invention has a housing 12 supported in cantilever fashion above a receptacle support 14 by a rearward leg 16. Mounted to the front of the housing is a manually actuatable, pivotal, outlet dispense faucet, or faucet, valve 18, four temperature-selection, electronic, capacitive contact switches 20, 22, 24 and 26 and an electronic LCD display 28. There my also be accommodation for selecting a preprogrammed maximum volume per dispense cycle. The receptacle support 14 may include a removable drip tray. During use, a cup or other hot water receptacle (not shown) is supported on top of the receptacle support 14 beneath the faucet 18.

A faucet photosensor 19 is mounted to the front of the housing 12 to detect movement of the faucet handle 21. Alternatively, the faucet actuation sensor could be any type of switch (mechanical, electrical, magnetic or otherwise) which will sense then the handle 21 is in the lowered open position. Alternatively, a faucet sensor may be integrated into the faucet to provide a signal when the handle 21 is pulled downwardly from the upright, closed position, as shown in FIGS. 1 and 2, to a relatively lowered, open position for dispensing the water.

A treaded hose connector 17 at the back of the housing 12 is connectable through a hose 15 to a suitable source of pressurized cold water from a wall faucet (not shown) of a public water utility source. Alternatively, the hose 15 is connected to a source of hot water from a domestic hot water tank at a warm temperature, such as 120-degrees Fahrenheit, although connection to such a hot water source will reduce temperature change response times and limit the range of possible temperatures compared to connection to a cooler source of water such as from a regular cold water tap. Also connected to the back of the housing are an electrical AC power cord and plug (not shown) and an on/off toggle switch 13. All of the other components of the hot water dispenser 10 described below with reference to FIG. 3, below, are protectively mounted within the housing 12.

The hot water dispenser 10 functions to dispense hot water while the faucet handle 21 is in the lowered, open position to allow free passage of hot water out of the outlet of the faucet 18 and into a glass, cup or other receptacle that may be placed on top of the receptacle support 14 and beneath the outlet of the faucet 18. The temperature of the hot water is either a preselected default temperature or one of four different preselectable temperatures respectively associated with the four temperature selection switches 20-26. In accordance with the present invention, the default temperature is generally the hottest temperature and each of the other temperatures is successively lower. For example, the default temperature may be 210-degrees Fahrenheit, while the temperatures of switches 20, 22, 24 and 26 may be 205-degrees, 200-degrees, 195-degrees and 180-degrees. The preselected temperatures associated with the switches may be selectively varied from near boiling temperature to the temperature of cold tap water to which the dispenser is connected through the inlet connector.

If one of the temperature selection switches has been actuated by touching the contact surface of the switch, then a back light behind the switch is energized to indicate which, if any, of the four temperatures has been selected. If an actuated switch is touched, then it is deactuated. If a deactuated switch is touched, then any currently actuated switch is deactuated automatically. The default or selected temperature may be shown on the display 28. The display 28 is also used for programming the dispenser with the selected temperature parameters prior to operation and to indicate other status indications such as ready, warming, heater off, et cetera. In lieu of the temperature selection switches, the display 28 may have a touch screen on which the different temperatures are displayed for selection by touching or a single toggle switch may be provided to scan though the different selectable temperatures on the display 28 for selection. Also, a rotary selection switch may be used in lieu of a plurality of temperature selection switches.

Figure 3:
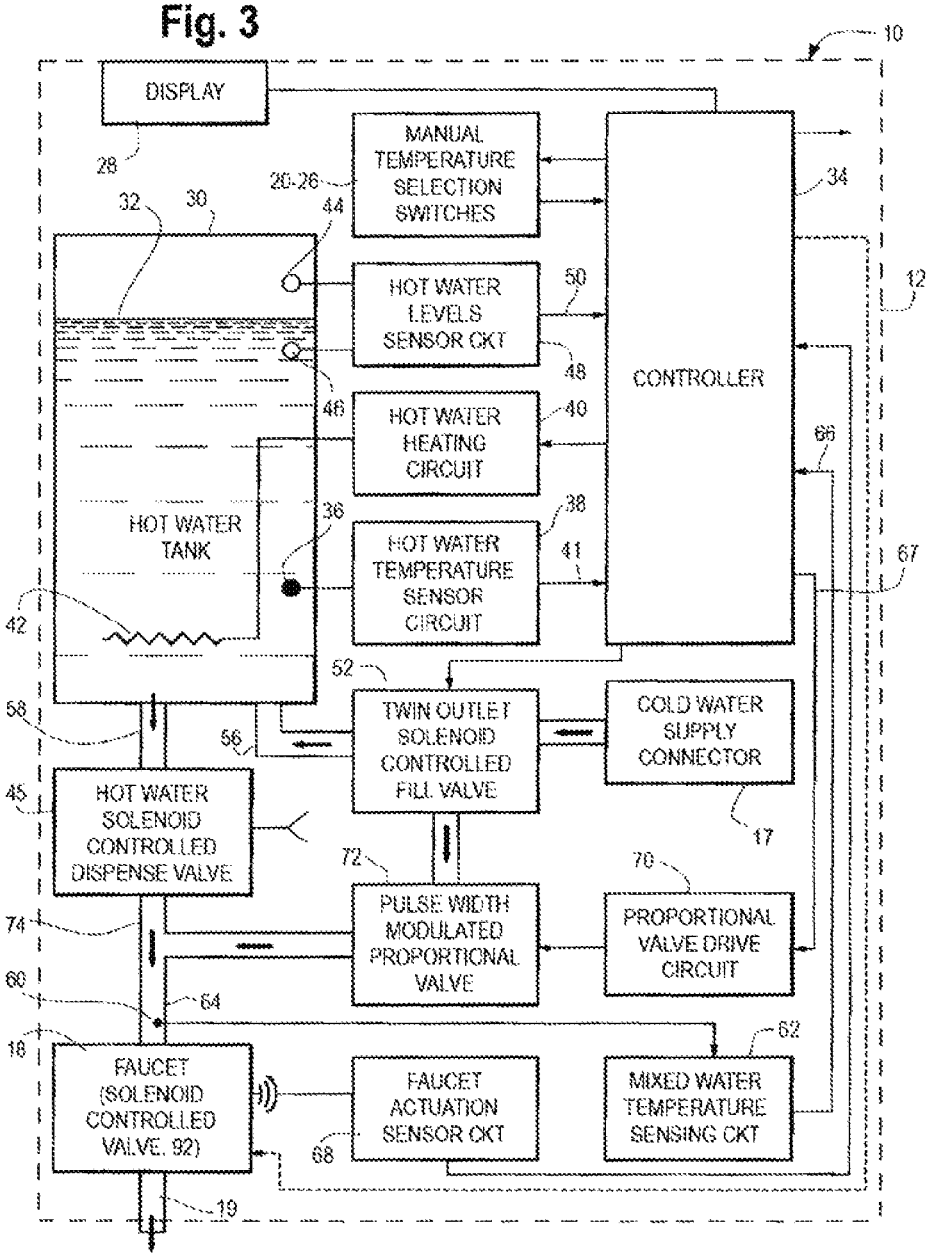
FIG. 3 is a functional block diagram of one form of the on-demand water dispenser of FIGS. 1 and 2.

Referring to FIG. 3, a number of functional elements are contained within or mounted to the housing 12, some of which are conventional. A hot water tank 30 is 14-inches tall, 7.7-inches deep and 7-inches wide and is generally kept full of hot water 32, approximately 3.2-gallons. The temperature of the hot water is determined by preselected hot water tank temperature stored in a parameter memory of a microcomputer based controller 34. An electronic hot temperature probe 36, immersed in the water 32 within the tank 30, such as a thermocouple based sensor, provides a temperature indicative signal to a hot water temperature sensor circuit 38. The hot water temperature sensor circuit 38 converts the hot water tank temperature indicative signal to a signal usable by the controller 34 and applies it to input 40 of the controller 34. When the indicated temperature falls beneath a preselected minimum level, the controller 34 actuates a hot water heating circuit 40 to switch AC power to an electrical heating element 42 to heat the hot water 32 in the hot water tank 30. When the indicated temperature rises above a preselected maximum temperature, then the controller 34 deactuates the hot water heating circuit to remove electrical power from the electrical heating element. The temperature of the hot water is thus kept between the preselected maximum temperature and the preselected maximum hot water tank temperature.

Similarly, the level of the hot water 32 in the hot water tank 34 is kept between a maximum level aligned with an electronic maximum level sensor 44 and a minimum level aligned with a minimum level, electrical sensor 46. The maximum and minimum levels are close enough to each other that the average level relative to the total depth of the hot water may be considered to be substantial fixed. Thus, the head pressure of the hot water remains relatively fixed. Accordingly, the hot water flows out through the hot water outlet 58 at a generally predetermined rate that generally remains the same while the dispensing continues. When the sensor detects that the handle 21 has been lowered to open the faucet 18, a hot water solenoid controlled dispense valve 45 connected to water outlet is opened by the controller 34. Then, the hot water, at a preselected temperature, such as 205-degrees Fahrenheit determined by the hot water temperature sensor circuit 38 and the controller 34, flows downwardly out through the hot water dispense valve 45 and the faucet outlet dispense valve 18 at a substantially fixed predetermined flow rate.

The outputs of the sensors 44 and 46 are interfaced to the controller 34 by a hot water levels sensor circuit 48 connected to an input 50. When the faucet 18 is opened, the actual level of the hot water 32 falls beneath the minimum preselected level, the controller responds by actuating a solenoid controlled fill valve 52. When actuated, the solenoid controlled fill valve fully opens to pass cold water from a cold water supply connector 54 through a cold water tank inlet 56 into the hot water tank 30. Preferably, the cold water is added to the hot water tank. 30 at a rate that matches the rate at which the hot water is being drained out through the hot water outlet to maintain the level at approximately the preselected minimum level. When the faucet 18 is closed, the solenoid remains open until the maximum level is sensed and the solenoid controlled valve is closed. The controller responds to the hot water levels sensor circuit 48 by de-energizing the solenoid controlled fill valve 52 to switch to a closed state to terminate filling. The cold water supply connector includes a hose connecting an inlet of the solenoid controlled valve to a pressurized, cold water tap of a public water supply or the like.

In accordance with the novel aspects of the hot water dispenser, the temperature of the water that passes out of the faucet 18, when actuated to an open position, is selectively altered by mixing the hot water passing from a hot water tank outlet 58 with cold water from the cold water supply connector 54. Unlike mixing systems that rely upon guess work or assumptions, the present system operates in real time in response to the actual sensed temperature of the mixed water as it is being mixed. Specifically, the rate, i.e. the ounces per second, at which the cold water is added to the hot water flow from the hot water outlet 58 is determined by the sensed temperature of the mixture of the hot and cold water as it is being mixed or immediately after it is mixed and before it passes from the faucet.

This is achieved, in part, by provision of a mixed water, electronic, temperature probe 60, such as a thermocouple, that produces a mixed water temperature indicative output signal that is passed to a mixed water temperature sensing circuit 62. As seen, the mixed water temperature probe 60 is located sufficiently downstream of the mixing chamber, or T-junction mixer, 74 where the hot water tank outlet 58 and a mixing inlet 64 are conjoined, to insure that sufficient mixing has been achieved to have obtained a substantially uniform temperature of the flowing mixture. A mixed water temperature sensing circuit 60 interfaces the mixed temperature signal to an input 66 of the controller 34. The controller 34 responds to the mixed temperature signal and the status of the manual temperature selection switches 20-26 to selectively cause a proportional valve drive circuit 70 to open an electronic proportional valve, or pulse width modulated proportional valve, 72 by an amount needed to obtain the desired temperature of the water from the faucet 18, when opened. Until the faucet is opened, the pulse width modulated proportional valve 72 is fully closed to prevent cold water flow into and up the outlet 58.

When the faucet 18 is manually moved to an open position, the movement of the faucet is sensed by a faucet actuation sensor circuit 68 connected to the photosensor 19. The faucet actuation sensor circuit 68 senses when a detectable element, or flag, carried by the pivotally mounted faucet handle moves into or out of a preselected position indicative of an open faucet valve. However, any type of sensing switch could be employed; mechanical, electrical, magnetic or otherwise. Once the faucet has been opened, the controller 34 responds to the mixed water temperature signal 66 by generating, a temperature control signal on its output 67 that is related to the temperature difference between the actual mixed water temperature, as sensed by the mixed water temperature probe 60, with the preselected temperature stored in the controller 34 that is currently selected.

This mixed temperature control signal on output 67 is applied to a proportional valve drive circuit 70. The proportional valve drive circuit 70 responds to the mixed temperature control signal by generating an output control signal applied to the pulse width modulated proportional valve 72. The output control signal from the proportional valve drive circuit 70 is a binary, pulse width modulated signal with a duty cycle that varies directly with the temperature difference between the sensed actual temperature and the preselected temperature stored in the controller. The degree to which the pulse width modulated proportional valve 72 opens from a fully closed position to a fully open position depends upon and directly varies with this duty cycle of the mixed temperature output control signal from the proportional valve drive circuit 70. The greater the temperature differential between actual temperature and the desired temperature the greater the duty cycle and input power provided to the pulse width modulated proportional valve 72 and the greater the rate at which cold water is introduced to a mixing chamber 74 through the pulse width modulated proportional valve 72 for mixing with the hot water from the hot water outlet 58.

The pulse width modulated proportional valve 72 is preferably one made by Deltrol Controls of Milwaukee, Wis. it has a maximum flow rate of 1.1 liters per minute at a pressure of 40-psi and 1.7 liters per minute at 90-psi. The valve mechanism is operated by a proportional valve drive circuit 701 coil with a nominal coil voltage of 24-VDC and power consumption of 13-watt at full duty cycle. The coil resistance is 44.3-ohms. The control signal from the proportional valve drive circuit 70 is a pulse width modulated signal at a frequency of 200-Hz, and a magnitude of 24-VDC. The flow rate at 40-psi when the valve is fully open is 1.7-liters per minute. The pulse width modulation input signal has a frequency of 200-Hz. Accordingly this fast acting valve can quickly respond to any changes in measured mixed temperature to increase or decrease the flow rate of cold water into the mixing chamber 74 and thereby quickly decrease or increase the measured mixed temperature of the mixed water that is dispensed from the faucet 18.

The cold water from the cold water supply connector 17 is passed to both the hot water tank cold water inlet 56 and to the pulse width modulated proportional valve 72 by opposite sides of a twin outlet solenoid controlled fill valve 52. This cold water fill valve 52 is preferably a V28 Series Solenoid Valve made by Invensys Company of France. It has a large threaded input connector that defines the cold water connector 17 and two valve outlets both connected to the connector 17 and controlled separately by a pair of solenoid coils. The two controlled outlets are respectively connected to the hot water tank 30 and to the pulse width modulated proportional valve 72. When the faucet actuation sensor circuit detects that the handle 21 has been moved to the open position, the controller responds by automatically energizing the one solenoid controlled valve associate with the output connected to the pulse width modulated proportional valve 72.

As the sensed mixed temperature decreases, the controller causes the duty cycle of the input control signal to the pulse width modulated proportional valve 72 to decrease and the pulse width modulated proportional valve passes less cold water. When the actual temperature is the same as the desired preselected temperature, then the flow rate of the pulse width modulated proportional valve 72 is maintained without change. Should the temperature rise, then the duty cycle increases and the pulse width modulated proportional valve 72 increases its valve opening and flow rate of cold water by an amount related to the duty cycle percentage. For instance, when the duty cycle is approximately 50%, then the pulse width modulated proportional valve may begin to open; when the duty cycle is 70%, then the pulse width modulated proportional valve 72 may allow a flow rate of approximately 0.5-liter per minute; when the duty cycle is 80 percent the flow rate may be 1-liter per minute and when the duty cycle is 100%, the pulse width modulated proportional valve 72 may be fully open to provide unatemperated cold water to the mixture at a maximum rate of 1.4-liters per minute, if desired.

Thus, it is possible to change the pulse width, or duty cycle, many times per second if needed to quickly correct the mixed water temperature. Thus, the temperature maintenance system of this invention can operate in a real time, relatively instantaneous feedback loop to maintain the correct temperature that has been selected. Thus, all the changes to temperature are only performed while the mixed water is actually being dispensed instead of before.

Figure 4:
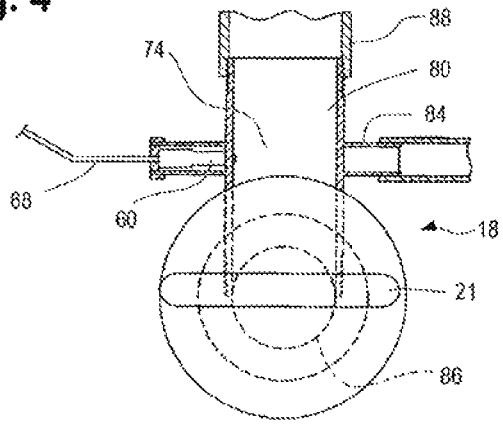
FIG. 4 is a schematic plan view of the faucet shown in FIG. 1 illustrating the connections to each of the hot water tank, the outlet temperature probe and the proportional valve of FIG. 3.

Referring to FIG. 4, the faucet is preferably like a Tomlinson® No Drip® except in addition to the threaded inlet connection 80 there are two relatively smaller inlet connections 82 and 84. The threaded hot water inlet connection 80 is generally horizontally directed and intersects at a right angle with a downturned vertical spout 86 from which the mixed hot water flows into a container resting on the container support 14, FIGS. 1 and 2. The distal end of the inlet connection is threadably connected directly to and is located adjacent to an outlet 88 of the hot water solenoid controlled dispense valve 45, FIG. 3. The one relatively smaller input 84 intersects with the inlet connector 80 at a location spaced from the distal end and near the down spout 86 and is connected with the cold water from the cold water supply connector 17 though the one outlet of the twin outlet solenoid controlled fill valve 52 through the pulse width modulated proportional valve 72, FIG. 3. The flow of cold water from the pulse width modulated proportional valve 72 is thus directed into the hot water flow within the inlet 80 at a right angle to maximize turbulence and mixing of the hot water, or relatively hotter water, with the cold water, or relatively colder water at a location within the inlet 80 directly opposite the opening of the inlet connection of the relatively smaller inlet 84. This location may be considered the mixing chamber 74, for mounted within the relatively smaller inlet connection 82 on a side of the inlet 80 located opposite the cold water inlet 84 is the temperature probe 60, which is preferably a thermocouple. An electrical lead 88 connected to the mixed water temperature sensing circuit 62, FIG. 3, passes out of the open end of the temperature probe inlet connector which has a water-tight removable closure. Alternatively, the relatively smaller inlet connectors 82 and 84 are connected to opposite sides of a cross joint shown in FIG. 5 which, in turn, is has an outlet 90 connected to the inlet 80 of a faucet like that of FIG. 4 but without lateral inputs 82 and 84.

Figure 5:
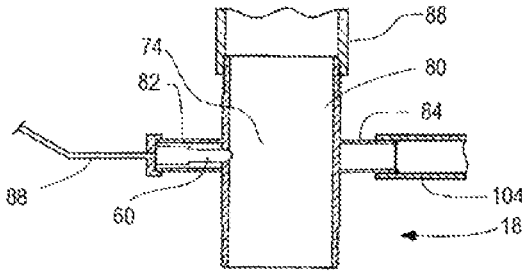
FIG. 5 is a schematic sectional plan view of a cross-joint that may be used with a faucet lacking inputs for cold water or for containing a temperature probe.
Figure 6:
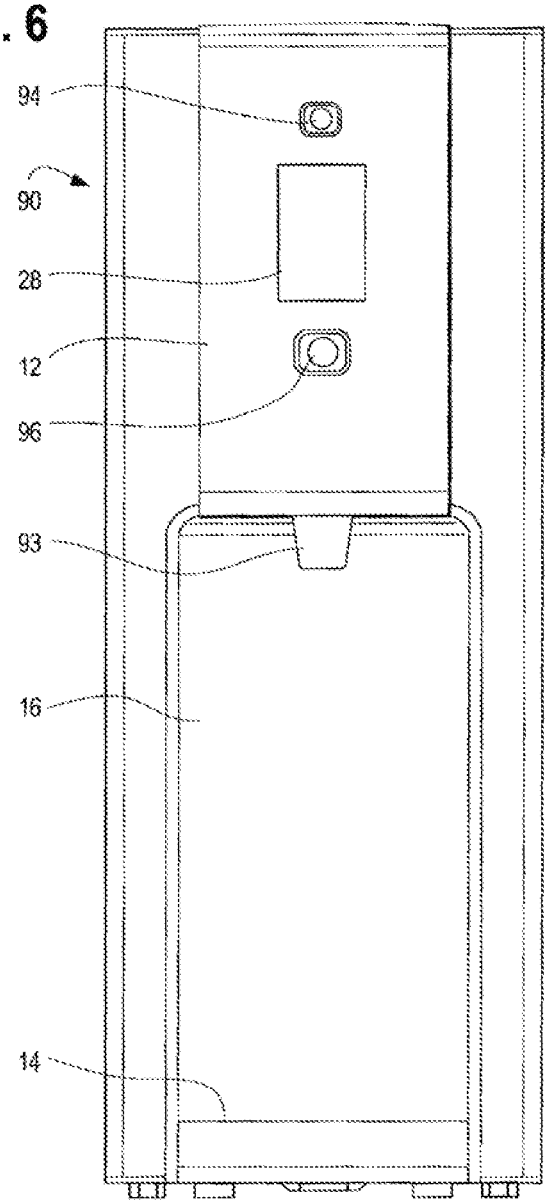
FIG. 6 is a front view of another form of the on-demand temperature controlled water dispenser of the present invention similar to that of the form of FIGS. 1-4 in which the manually operated dispense faucet has been replaced by a solenoid controlled outlet dispense valve.
Figure 7:
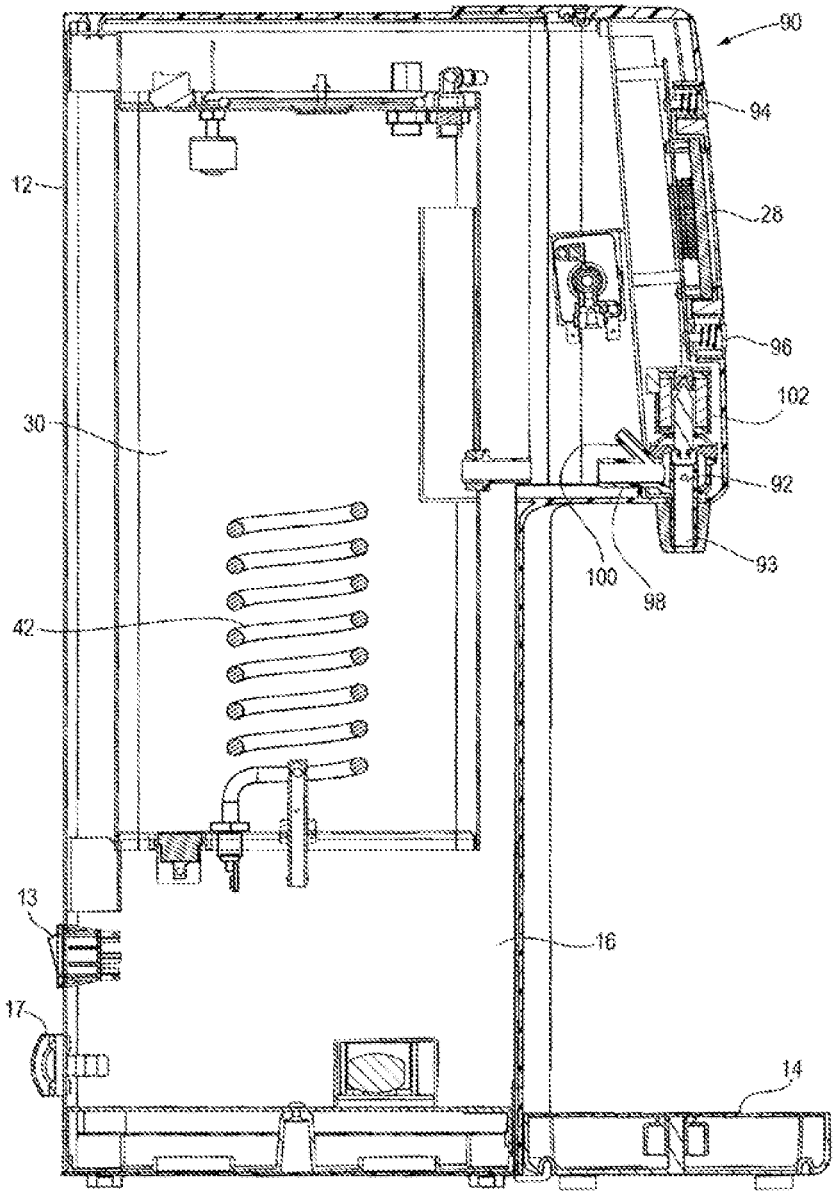
FIG. 7 is a sectional side view of the on-demand water dispenser of FIG. 5.
Figure 8:
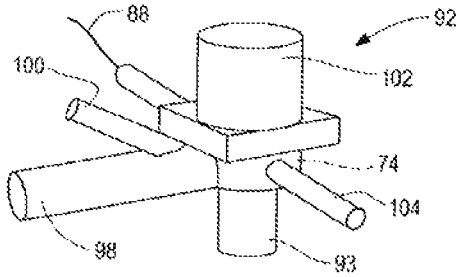
FIG. 8 is front view of one style of solenoid controlled valve that may be used as the outlet dispense valve in embodiment of the on-demand water dispenser of FIGS. 5-6.

Referring to FIGS. 5, 6 and 7, another form of the on-demand hot water dispenser 90 is shown in Which the faucet 18 has been replaced with a solenoid controlled outlet dispense valve 92 with an outlet nozzle 93. Parts similar to parts in the embodiment of FIGS. 1-5 have been given the same reference numerals and perform the same functions as described above. In addition, the four individual temperature selection switches 20, 22, 24 and 26 have been replaced with a single toggle switch 94. Each time the toggle switch 94 is actuated, a different one of a plurality of different temperatures shown on the display is selected and highlighted to indicate the selection. Instead of a faucet handle 21, a dispense actuation switch 96 is provided. While the dispense actuation switch is held in an inward actuation position, the solenoid controlled outlet dispense valve 92 is energized to open the valve and dispense the mixed water from the spigot 93. Although not all are shown, all the parts shown in FIG. 3 and described above with reference to the on-demand hot water dispenser 10 are also present and perform the same functions described above, except the photosensor 19 and faucet actuation sensor circuit 68, which are not needed and eliminated. Instead, when the outlet dispense actuation switch 96 is actuated, a signal is automatically sent to the controller 34.

Referring to FIG. 6, the solenoid controlled outlet dispense valve 92 has a horizontal relatively large inlet pipe 98 connected to the outlet of the hot water solenoid controlled dispense valve 45 with relatively smaller inlet 100 that is directly connected to appropriate outlet of the twin outlet solenoid controlled cold water fill valve 52. Another relatively small inlet connector 100 protectively houses the probe 60 (not shown), such that the mixing chamber 74 is formed directly above the downturn spout 93 at the junction with the inlet 98 and the inlet 98. In this case mixing occurs between the junction of the cold water inlet 100 with the hot water inlet 98 and the inlet 88 at the closed end of the inlet 98. The solenoid coil 102 is supported above the spout 93 and a vent tube 104 open to atmosphere extends above the hot water tank. As noted, this outlet dispense valve is preferably a Model DSVP11N solenoid controlled valve made by Deltrol Controls, a division of Deltrol Corp. of Milwaukee, Wis.

The controller 34, FIG. 3, includes a microprocessor (not shown) with a suitable memory for entering and storing different preselected operating parameters, such as hot water tank temperature, the level of each of the preselectable temperatures that may be selected by the operator and the level of the preselected default temperature that is used in place of a proactively selected one of the temperature as the preselected temperature at which the hot water will be dispensed.

Figure 9:
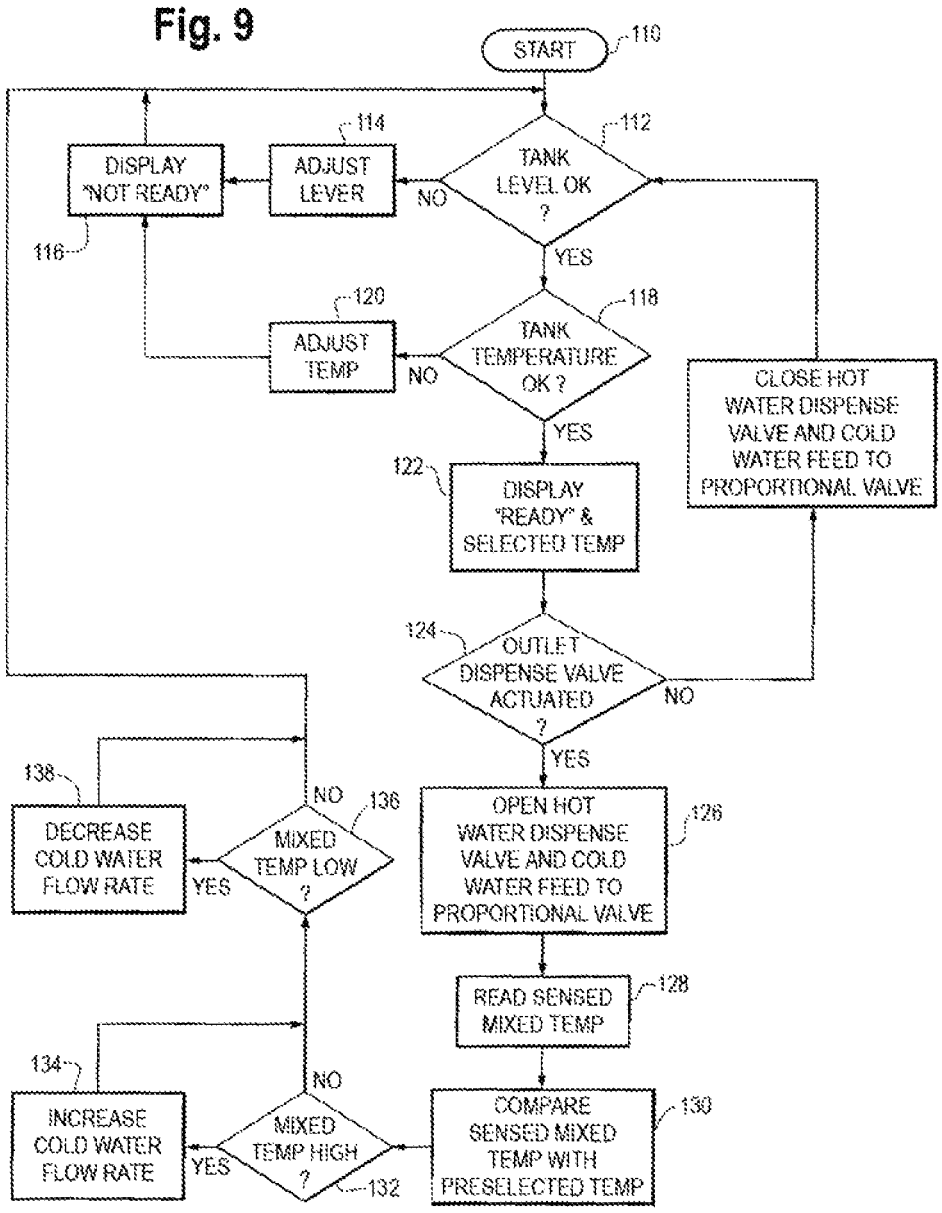
FIG. 9 is a logic flow chart illustrating the operation of the dispensers of FIGS. 1-8.

After all these parameters have been entered and stored and AC power has been applied to the on-demand hot water dispenser, the controller generally operates in accordance with the logic flow chart of FIG. 9. After start 110, in step 112, a determination is made as to whether the hot water level in the hot water tank 32 is at the correct preselected level. If not, and the level is too low, in step 114 the controller 34 energizes one of the twin outlet solenoids controlling the connection between the cold water supply connector 17 and the tank fill inlet 56 to open the valve and add more water to the hot water tank until the maximum level is detected by the level sensor 44. The cold water fill valve is then closed. Each time any significant amount of hot water is being drawn from the hot water dispenser 10 or 90, the level falls beneath the minimum level sensor 46, FIG. 1. Until refilling is completed, the controller causes the display 28 to display the message: "NOT READY", or if dispensing is in process, the message "DISPENSE AT _____ DEGREES F.", in which the blank is filled in with the selected temperature or the default temperature if no other selection has been made.

Once the tank level is correct, then in step 118, a determination is made as to whether the temperature of the water in the hot water tank is correctly between the two preselected maximum and minimum temperatures. Each time cold water is added to the tank 32 after a dispense cycle, the temperature of course drops and then must be reheated. If the temperature is not correct, then it is adjusted as needed by the hot water heating circuit in step 120. Once both the level and temperature are acceptable, then in step 122 the message "READY-SELECT TEMPERATURE" is displayed.

Next, in step 124 a determination is made as to whether the outlet dispense valve, either faucet outlet dispense valve 18 or solenoid controlled outlet dispenser valve 92, is actuated to an open position. In the case of the faucet 18 this determination is based on the inputs from the faucet actuation sensor circuit 68 while in the dispenser 90, actuation of the dispense actuation switch 96 provides an actuation signal to the controller 34.

If there is no actuation, the hot water solenoid controlled outlet valve 45 and the cold water valve feeding the proportional valve 72 are kept closed, and the program recycles to the beginning. Once actuation of the of the outlet dispense valve is detected in step 124, then in step 126, the hot water outlet valve 45 and the cold water feed valve portion of the twin outlet valve 52 are opened. At the same time, in step 128 the mixed temperature in the mixing chamber 74 is sensed and in step 130 the sensed temperature is compared to the temperature that has been preselected. The comparison is then used to either increase or decrease the flow rate of the cold water being fed to the mixing chamber 74 by the proportional valve 72 to maintain the temperature at the preselected temperature in steps 132, 134, 136 and 138. The program then returns to the start of the program and repeatedly recycles at a high speed. This high speed is much higher than the 200-Hz frequency of the variable duty cycle input signal to the proportional valve much such that the duty cycle and thus cold water flow rate can be changed for each cycle of the input signal for virtually instantaneous corrections to temperature of the hot water being dispensed while the water is in the process of being dispensed.

Thus, in accordance with the present invention, a method of dispensing hot water at different selected temperatures is provided by performing the steps of:

(1) dispensing hot water from a hot water tank at a generally uniform hot temperature, (2) preselecting a temperature that is lower than the temperature of the hot water in the hot water tank; (3) mixing cold water with the hot water from the tank during dispensing of the water from the tank; (4) measuring the mixed temperature of the mixed water obtained by mixing the hot water with the cold water during the dispensing of the hot water from the tank and the dispenser; (5) comparing the preselected temperature with the mixed temperature; and (6) controlling a proportional valve in response to the temperature comparing to mix cold water with the hot water at a rate needed to achieve a mixed temperature that is substantially equal to the preselected temperature. In accordance with the method, if different preselected temperatures are selected, then the proportional valve is opened by different amounts. Generally, the lower the preselected temperature is, the greater the amount that the proportional valve needs to be open to provide the increased mixing cold water flow rate. If no temperature is preselected, then the proportionate valve may remain closed.

In accordance with the present invention, the temperature control system is not adversely affected by variations in the water pressure being obtained from the public water works or other source. If the percentage of valve opening of the proportionate valve remains the same despite an increase in mixing cold water pressure, then the rate of cold water passing through the proportionate valve will increase and the temperature of the mixed water would drop. Likewise, if the pressure were to decrease, then the temperature would increase. This sensitivity to water pressure is overcome by measuring the mixed water temperature and adjusting the proportionate valve accordingly. If the mixing cold water pressure increases, the resultant decrease in the mixed temperature is detected and the proportionate valve adjusted to reduce the cold water flow rate by the amount it was increased by increased pressure. Likewise, if the water pressure drops, then the resultant increase in temperature of the mixed water cause by resulting decreased flow of mixing cold water is compensated for by increasing the degree to which the proportionate valve is open.

Similarly, while the temperature in the hot water tank is controlled, the temperature of the cold water does not need to be controlled and may vary with the seasons and regions and other uncontrollable factors. If the cold water should be come colder, then the mixed temperature will drop faster for the same rate, but when the desired temperature is achieved, the proportional valve will still be correctly adjusted.

Thus, a hot water dispenser is provided that is capable of digitally providing hot water at a variety of different selectable temperatures accurately, quickly, reliably and repeatedly.

It should be appreciated that changes may be made without departing from the spirit of the invention. For instance, although the mixed temperature is measured before the mixed water is dispensed, a remote, infrared sensing temperature sensor could be mounted to the outside of the housing 12 and aimed at the outlet stream of mixed water from the faucet or other hot water outlet dispense valve. While a twin outlet solenoid controlled cold water fill valve 52 is used to both fill the hot water tank 32 and to feed cold water to the proportional valve 72, it should be appreciated that alternatively two separate solenoid controlled valves that do not share a common inlet could be used without any change to the control system. While the cold water is preferably provided directly from a utility cold water outlet, the invention would work equally as well with another source of mixing water that is kept in a separate tank like the hot water tank. Other obvious variations and equivalents will occur to persons of ordinary skill in the art. Reference should therefore be made to the appended claims to ascertain the scope and breadth of the invention.

The invention claimed is:

1. A method of dispensing hot water from a dispenser at a preselected temperature on-demand, comprising the steps of:

providing a source of relatively hotter water by maintaining hot water in a hot water tank at a preselected temperature and a preselected head pressure;

providing a source of relatively coot water at a temperature less than the preselected temperature, said source of cooler water and the source of hotter water being the only sources of water;

sensing when an outlet dispense valve has been actuated to an open state;

dispensing water from the hot water tank with a solenoid controlled hotter water valve at a substantially constant, preselected flow rate to an inlet of a mixing chamber in response to the outlet dispense valve being sensed to be in an actuated open state;

dispensing cooler water to another inlet of the mixing chamber through a cooler water solenoid controlled fill valve feeding a pulse-width modulated proportional valve in response to the outlet dispense valve being sensed to be in an actuated state;

sensing the temperature of mixed water in the mixing chamber with a temperature sensor mounted within a temperature sensor mounting inlet of the mixing chamber;

controlling the proportional valve in response to the temperature sensor to pass water out of the mixing, chamber at a preselected temperature when the dispense valve being actuated to a an open state;

passing mixed water from an outlet of the mixing chamber to the dispense valve in response the dispense valve being actuated to an open state; and closing the cooler water fill valve and the hotter water solenoid controlled valve in response to the dispense valve being sensed to not being in the open state; and providing the mixing chamber as a central junction of a four legged cross-joint with one leg connected to the hotter water source, a second leg connected to the cooler water source through the proportional valve, a third leg containing the temperature sensor, and a forth leg connected to the dispense valve.

2. An on-demand hot water dispenser, comprising:

a source of hotter water including a hot water tank maintained at a preselected relatively elevated temperature and a preselected head pressure;

a source of cooler water at an uncontrolled but relatively non-elevated temperature compared to the hotter water, the source of hotter water and the source of cooler water being the only sources of water;

an electrical temperature sensor;

a mixing chamber with a pair of water inlets, a water outlet and a temperature sensor mounting inlet for receipt and mounting, of the temperature sensor within the mixing chamber, the cooler water source being connected to one of the inputs of the mixing chamber through a solenoid controlled fill valve and an electrically controlled proportional valve with a variable flow rate, and another one of the inlets being connected to the hot water tank through a solenoid controlled dispense valve to receive water from the hot water tank at a preselected uniform rate;

an outlet dispense valve with an inlet connected with the mixing chamber, and an outlet for dispensing mixed water from the mixing chamber into the air;

an outlet actuation sensor for sensing when the outlet dispense valve has been actuated to an open state;

means responsive to the outlet actuation sensor to control the solenoid controlled dispense valve to block passage of water to the mixing chamber from the hot water tank and to block passage of water to the proportional valve when the dispense valve has not been actuated to the open state; and means responsive to the electrical temperature sensor during, dispensing to control the variable flow rate through the proportional valve to maintain the mixed temperature of the water being dispensed from the outlet dispense valve at a preselected temperature; and the mixing chamber is a central junction of a four legged cross-joint with one leg connected to the hotter water source, a second leg connected to the cooler water source through the proportional valve, a third leg containing the temperature sensor, and a forth leg connected to the outlet dispense valve.

3. The on-demand hot water dispenser of claim 2 in which the mixing chamber is within the outlet dispense valve.

4. The on-demand hot water dispenser of claim 2 in which the mixing, chamber has an outlet freely open to an inlet of the outlet dispense valve and is located adjacent to an inlet of the outlet dispense valve and adjacent an outlet from the hotter water source.

5. The on-demand hot water dispenser of claim 2 in which the outlet dispense valve is a manually operated faucet.

6. The on-demand hot water dispenser of claim 2 in which the outlet dispense valve is a solenoid controlled valve having three inputs respectively connected to the source of hotter water, the source of cooler water and containing the temperature sensor, and an outlet connected to the outlet dispense valve.

7. The on-demand hot water dispenser of claim 2 including means for maintaining, the hot water in the hot water tank within a preselected range of temperatures while the source of cooler water is used at whatever temperature it is made available from the public utility.

8. The on-demand hot water dispenser of claim 2 in which the proportional valve is a solenoid controlled valve with a pulse modulated electrical input signal with a duty cycle that determines the flow rate of water through the proportional valve.

9. The on-demand hot water dispenser of claim 8 including a controller connected with temperature sensor and the proportional valve and having means for storing the preselected temperature, said controller being responsive to the preselected temperature and to the mixed temperature detected by the temperature sensor to vary the duty cycle of the pulse modulated electrical input signal, change to the duty cycle causing a corresponding change to the flow rate through the proportional valve as needed to change the mixed temperature to the preselected temperature during mixing and dispensing.

10. The on-demand hot water dispenser of claim 9 including means for manually inputting to the controller for storage a selected one of a plurality of different preselectable temperatures obtainable by the hot water dispenser.

* * * * *